US011131183B2

(12) United States Patent
Mericas

(10) Patent No.: US 11,131,183 B2
(45) Date of Patent: Sep. 28, 2021

(54) RESTRICTION SYSTEM FOR TRACKING DOWNHOLE DEVICES WITH UNIQUE PRESSURE SIGNALS

(71) Applicant: Halliburton Energy Services, Inc., Houston, TX (US)

(72) Inventor: Chris J. Mericas, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 580 days.

(21) Appl. No.: 16/074,288

(22) PCT Filed: Apr. 29, 2016

(86) PCT No.: PCT/US2016/030112
§ 371 (c)(1),
(2) Date: Jul. 31, 2018

(87) PCT Pub. No.: WO2017/188992
PCT Pub. Date: Nov. 2, 2017

(65) Prior Publication Data

US 2021/0148219 A1 May 20, 2021

(51) Int. Cl.
*E21B 47/09* (2012.01)
*E21B 47/06* (2012.01)

(52) U.S. Cl.
CPC ..... *E21B 47/09* (2013.01); *E21B 47/06* (2013.01)

(58) Field of Classification Search
CPC ..... E21B 34/142; E21B 47/09; E21B 47/06; E21B 23/08; E21B 23/04
See application file for complete search history.

(56) References Cited

U.S. PATENT DOCUMENTS 4,483,393 A * 11/1984 More ..... E21B 17/003 166/65.1
6,401,814 B1 6/2002 Owens et al.
6,536,291 B1 3/2003 Gysling et al.
(Continued)

FOREIGN PATENT DOCUMENTS

GB 2393465 A 3/2004
WO 2014197834 A1 12/2014

OTHER PUBLICATIONS

Patent Cooperation Treaty, International Search Report and Written Opinion, PCT Appln, No. PCT/US2016/030112, dated Jan. 24, 2017.

*Primary Examiner* — Brad Harcourt
(74) *Attorney, Agent, or Firm* — McGuireWoods LLP

(57) ABSTRACT

Restriction systems are methods of tracking downhole devices as they are displaced in tubulars are provided. An example restriction system comprises a tubular comprising at least one series of restrictions disposed on an interior surface of the interior of the tubular; a pressure sensor configured to measure the tubular pressure; and a downhole device capable of traversing the series of restrictions. An example method comprises providing a tubular comprising at least one series of restrictions disposed on an interior surface of the interior of the tubular, and a pressure sensor disposed on an interior surface of the interior of the tubular. The example method further comprises introducing a downhole device into the tubular and measuring the pressure within the tubular as the downhole device traverses the at least one series of restrictions.

20 Claims, 2 Drawing Sheets

(56) References Cited

U.S. PATENT DOCUMENTS

| | | | | |
|---|---|---|---|---|
| 6,907,936 | B2 * | 6/2005 | Fehr | E21B 33/122 166/387 |
| 9,534,471 | B2 * | 1/2017 | Etzel | E21B 34/14 |
| 9,683,419 | B2 * | 6/2017 | Coon | E21B 47/09 |
| 2003/0062155 | A1 | 4/2003 | Summers | |
| 2004/0020643 | A1 | 2/2004 | Thomeer et al. | |
| 2011/0056692 | A1 | 3/2011 | Lopez De Cardenas et al. | |
| 2013/0206425 | A1 * | 8/2013 | Mazyar | E21B 33/12 166/376 |
| 2013/0255963 | A1 | 10/2013 | Guerrero et al. | |
| 2014/0151037 | A1 * | 6/2014 | Morgan-Smith | E21B 47/12 166/255.2 |
| 2015/0068772 | A1 | 3/2015 | Richards et al. | |
| 2016/0076363 | A1 * | 3/2016 | Morrow | E21B 43/11 166/255.1 |

* cited by examiner

RESTRICTION SYSTEM FOR TRACKING DOWNHOLE DEVICES WITH UNIQUE PRESSURE SIGNALS

TECHNICAL FIELD

The present disclosure relates to tracking downhole devices run in a tubular for use in a wellbore environment and more particularly to modification of the profile of the inner diameter of a tubular such that a downhole device inserted into the tubular may be tracked as it passes the modified profile of the inner diameter.

BACKGROUND

In a wellbore it may be desirable to introduce a downhole device into a tubular. For example, downhole devices such as plugs, darts, balls, and the like may be introduced into a tubular to separate fluids, activate a downhole tool, clean the tubular, remove an obstruction, etc. Typically, a downhole device is introduced and displaced in the tubular to a specific location where the downhole device may perform its desired function. However, although the necessary displacement volume may be calculated, these calculations are frequently erroneous due to downhole tolerances, stretch, and other variables; and the resulting inaccuracies in the calculation may lead to over- or underdisplacement.

Consequently, methods of tracking the location of a downhole device have been devised to correct for inaccuracies in the calculation of the displacement volume. For example, some methods may modify the downhole device with a deformable structure that deforms when the downhole device passes a specific structure in the tubular. As the deformable structure on the device deforms, the pressure in the tubular may change and this change in pressure may be measured, in turn signaling an operator who observes the pressure change. However, the deformable structure may only deform once, and as such the system is only able to indicate the location of the downhole device after it has passed the one specific structure in the tubular which induced deformation of the deformable structure on the downhole device.

Alternatively, other methods have been developed that allow for continual tracking along the length of the tubular. These methods generally consist of attaching a wire or a fiber optic cable to the downhole device to track its location as it is displaced in the tubular. However, these methods are only able to track a downhole device for the length of the attached wire. This may be problematic in tubulars that extend several thousands of feet. Additionally, if the wire gets caught or cut along some feature within the inner diameter of the tubular, it may no longer be possible to track the downhole device. If the downhole device is not displaced the correct distance within the tubular, remedial operations may need to be performed. For example, if a cement plug is placed at the wrong location, remedial cementing operations may be needed to achieve the desired cementing application.

BRIEF DESCRIPTION OF THE DRAWINGS

Illustrative examples of the present disclosure are described in detail below with reference to the attached drawing figures which are incorporated by reference herein, and wherein.

Figure 1:
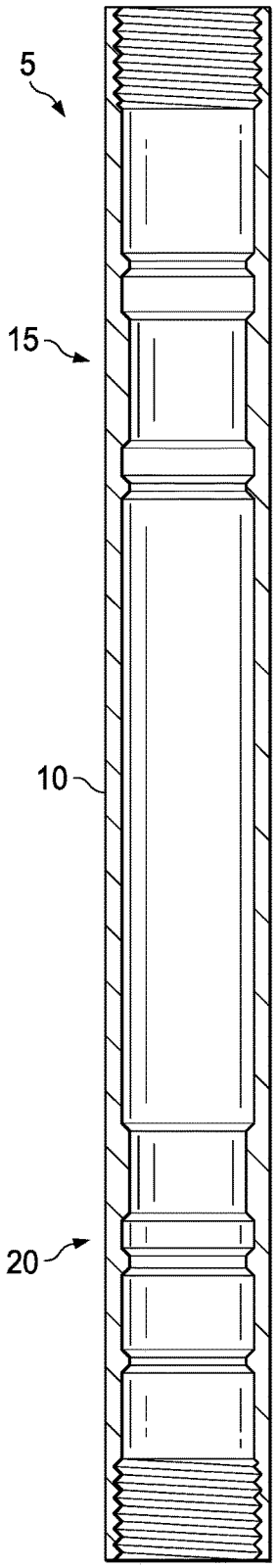
FIG. 1 is a an illustration of a tubular comprising a first series of restrictions and a second series of restrictions.

The illustrated figures are only exemplary and are not intended to assert or imply any limitation with regard to the environment, architecture, design, or process in which different examples may be implemented.

DETAILED DESCRIPTION

The present disclosure relates to tracking downhole devices run in a tubular for use in a wellbore environment and more particularly to modification of the profile of the inner diameter of a tubular such that a downhole device inserted into the tubular may be tracked as it passes the modified profile of the inner diameter.

Disclosed examples may include a system comprising a series of restrictions disposed at at least one specific location within the interior of a tubular. The series of restrictions produces a unique profile on the surface of the interior of the tubular. As a downhole device traverses the series of restrictions, the pressure within the tubular is changed in a specific pattern corresponding to the specific series of restrictions. This pattern of pressure change may be measured by pressure sensing equipment, and the pressure sensing equipment may generate a signal corresponding to the measured pattern of pressure change. The generated signal may correspond with the known pressure signature for the specific series of restrictions. Therefore, when the pressure sensing equipment measures a pattern of pressure change corresponding to a known pressure signature for a specific series of restrictions, an operator will then know that the downhole device passed through that specific series of restrictions at the time the pattern of pressure change was observed. An operator may then chart the downhole device's progress as it is displaced within the tubular. Further, a plurality of series of restrictions may be used within a tubular or a series of tubulars. Each series of restrictions is unique and produces a unique profile on the surface of the interior of the tubular. As described above, a pattern of pressure change is generated as a downhole device traverses each series of restrictions, and as each series of restrictions is unique, so too is the pattern of pressure change generated from the downhole device traversing a series of restrictions. As the unique pressure signature for each series of restrictions is known, when the signal generated by the pressure sensing equipment matches a known pressure signature, an operator will know the specific series of restrictions that the downhole device has just traversed as well as which, if any, series of restrictions the downhole device has yet to traverse.

Advantageously, the system allows a downhole device to be tracked as it is displaced within a tubular. Further, the system does not require modification of the downhole device in order to track the location of the downhole device. For example, the system does not require that the downhole device be attached to a wire or cable. As another example, the system does not require that the downhole device be modified such that it may deform as it is displaced in the tubular. Further advantageously, the system may utilize as many series of restrictions as desired, allowing an operator to tailor the depths at which the downhole device may be tracked, as well as the frequency of measurements used to track the downhole device.

Disclosed examples comprise a tubular with at least one series of restrictions located at a specific location on the interior surface within the interior of a tubular. FIG. 1 illustrates a restriction system 5 comprising a tubular 10. Restriction system 5 may comprise any number of tubulars 10. Tubular 10 may be any type of tubular in which a downhole device may be disposed. More particularly, the tubular 10 may any type of oilfield tubular. Examples include, but are not limited to, drill pipe, drill collars, pup joints, casing, production tubing, pipeline, or combinations thereof. Tubular 10 comprises a first series of restrictions 15 uphole from a second series of restrictions 20. The terms uphole and downhole may be used to refer to the location of various components relative to the bottom or end of a wellbore. For example, a first component described as uphole from a second component may be further away from the end of a wellbore than the second component. Similarly, a first component described as being downhole from a second component may be located closer to the end of wellbore than the second component. Further, it is to be understood that, as used herein, "first," "second," "third," etc., are arbitrarily assigned and are merely intended to differentiate between two or more series of restrictions, tubulars, etc., as the case may be, and does not indicate any particular orientation or sequence. Furthermore, it is to be understood that the mere use of the term "first" does not require that there be any "second," and the mere use of the term "second" does not require that there be any "third," etc. As illustrated in FIG. 1, tubular 10 has been constructed to comprise the first series of restrictions 15 and the second series of restrictions 20. However, a series of restrictions may be added to a tubular 10. For example, an interior surface of tubular 10 may be milled out to comprise the desired series of restrictions. Alternatively, a series of restrictions may be inserted into tubular 10 and welded or otherwise attached into place within the interior of tubular 10. Further alternatively, materials, for example, metals, may be electrodeposited into tubular 10 in a specific desired orientation to construct a series of restrictions on an interior surface of tubular 10. The deposited materials may then be affixed to the interior surface of tubular 10 in any desirable method including welding, adhesives, etc.

In examples, a series of restrictions (e.g., the first series of restrictions 15 and the second series of restrictions 20 as illustrated in FIG. 1) comprises a pattern of restrictions. The pattern of restrictions comprises at least two restrictions. The restrictions may comprise any length or depth within the tubular. The restrictions may generally run widthwise along the circumference of an interior surface of the interior of the tubular (e.g., tubular 10 as illustrated in FIG. 1). Altering the length and depth of a restriction changes the pattern of the pressure change. For example, increasing the length of a restriction increases the duration of the pressure spike as the downhole device passes the restriction. Conversely, decreasing the length of the restriction decreases the duration of the pressure spike as the downhole device passes the restriction. The pattern of pressure change is also affected by the number of restrictions in the series of restrictions. For example, two restrictions with relatively small lengths will show two brief duration pressure spikes in the pattern of pressure change. If these two restrictions are followed by a restriction with a longer length, the two brief duration pressure spikes will be followed by a much longer duration pressure spike in the pattern of pressure change. The pattern of pressure change thus corresponds with a known pressure signature which is unique to each series of restrictions. As the length, depth, and number of restrictions for a series of restrictions is known when the series of restrictions is constructed in the tubular, the pressure signature for that specific series of restrictions, as well as its location in the tubular, will also be known. Each series of restrictions comprises a unique pattern of restrictions such that each series of restrictions has a corresponding known pressure signature. In the illustrated example of FIG. 1, the first series of restrictions 15 does not comprise the same pattern of restrictions as the second series of restrictions 20. As such, the first series of restrictions 15 has a different known pressure signature from the second series of restrictions 20, and the different pressure signatures allow the first series of restrictions 15 to be distinguished from the second series of restrictions 20.

Figure 2:
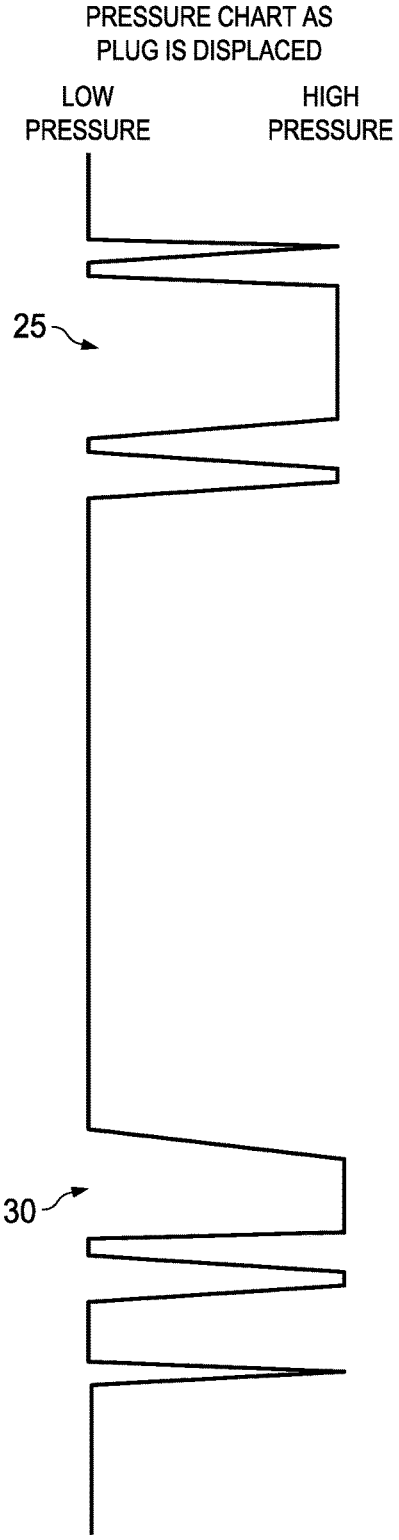
FIG. 2 illustrates an example pressure chart corresponding to the pattern of pressure change for tubular 10 illustrated in FIG. 1.

FIG. 2 illustrates an example pressure chart corresponding to the pattern of pressure change for tubular 10 illustrated in FIG. 1. Pattern of pressure change 25 corresponds to the first series of restrictions 15 illustrated in FIG. 1. Pattern of pressure change 30 corresponds to second series of restrictions 20 illustrated in FIG. 1. As illustrated in FIG. 2, when a downhole device passes the first series of restrictions 15 illustrated in FIG. 1, the pattern of pressure change 25 will change according to the pattern of restrictions of the first series of restrictions 15. For example, the pattern of pressure change 25 illustrates a short duration pressure spike followed by a longer duration pressure spike followed by a shorter duration pressure spike. As illustrated in FIG. 1, the first series of restrictions 15 comprises a smaller restriction followed by a longer restriction followed by another smaller restriction. As tubular 10 was constructed with the first series of restrictions 15, and as the length of tubular 10 is known when introduced into the wellbore, the depth at which the first series of restrictions 15 is located will also be known. Therefore, if the first series of restrictions 15 was located at 2,500 feet within tubular 10, when the pattern of pressure change matches the known pressure signature for the first series of restrictions 15, it will be known that the downhole device has reached a depth of 2,500 feet. As another example and also as illustrated in FIG. 2, when the downhole device passes the second series of restrictions 20 illustrated in FIG. 1, the pattern of pressure change 30 will change according to the pattern of restrictions of the second series of restrictions 20. For example, the pattern of pressure change 30 illustrates a medium duration pressure spike followed by a shorter duration pressure spike followed by another shorter duration pressure spike. As illustrated in FIG. 1, the second series of restrictions 20 comprises a medium length restriction followed by two shorter length restrictions. As tubular 10 was constructed with the second series of restrictions 20 and as the length of tubular 10 is known when introduced into the wellbore, the depth at which the second series of restrictions 20 is located will also be known. Therefore, if the second series of restrictions 20 was located at 5,000 feet within tubular 10, when the pattern of pressure change matches the known pressure signature for the second series of restrictions 20, it will be known that the downhole device has reached a depth of 5,000 feet.

The series of restrictions may be disposed within a tubular (e.g., tubular 10 as illustrated in FIG. 1) that is run at any depth. For example, a series of restrictions may be disposed within the tubular 10 at a depth of 1,000 feet, 2,000 feet, 3,000 feet, 4,000 feet, 5,000 feet, 6,000 feet, 7,000 feet, 8,000 feet, 9,000 feet, 10,000 feet, or greater than 10,000 feet. It is to be understood that in some examples, the specific depth at which the series of restrictions is located may be an arbitrary matter of choice so long as the depth at which the series of restrictions is located is known, and the pressure signature for the series of restrictions located at said depth is also known. Alternatively, the depth of the series of restrictions may not be an arbitrary matter of choice. For example, if a downhole device is to be run to a specific depth, a series of restrictions must be placed uphole of that specific depth in order to detect that the downhole device has passed the series of restrictions as it is displaced in the tubular. As such, some series of restrictions may be placed at specific depths within a tubular at which it would be desirable to chart the progress of the displacement of a specific downhole device.

As discussed above, the series of restrictions may be placed in a pre-existing tubular (e.g., tubular 10 as illustrated in FIG. 1) for example by forming the restrictions separately and welding the restrictions into place or by electrodepositing the restrictions into the tubular and affixing the deposited materials into place. In these examples, the restrictions may be made from degradable materials. As used herein, "degradable materials" refers to materials which degrade upon contact with another material, e.g., a solvent. The degradable materials may be dissolvable plastics or metals which may be dissolved by any suitable solvent including both polar and nonpolar solvents. As a specific example, a series of restrictions made out of aluminum may be dissolved with a caustic such as sodium hydroxide. In other examples, the degradable materials may comprise such metals capable of forming a galvanic couple and undergoing galvanic corrosion in the presence of an electrolyte. In some examples, the restrictions may comprise both the cathodic material and the anodic material. In alternative examples, the restrictions may only comprise the anodic material, and the cathodic material may be part of the tubular or present elsewhere within the tubular. As a specific example, the series of restrictions may be composed of composite of copper and zinc. Upon exposure to an electrolyte, the zinc may undergo galvanic corrosion, and the series of restrictions would therefore at least partially degrade.

Figure 3:
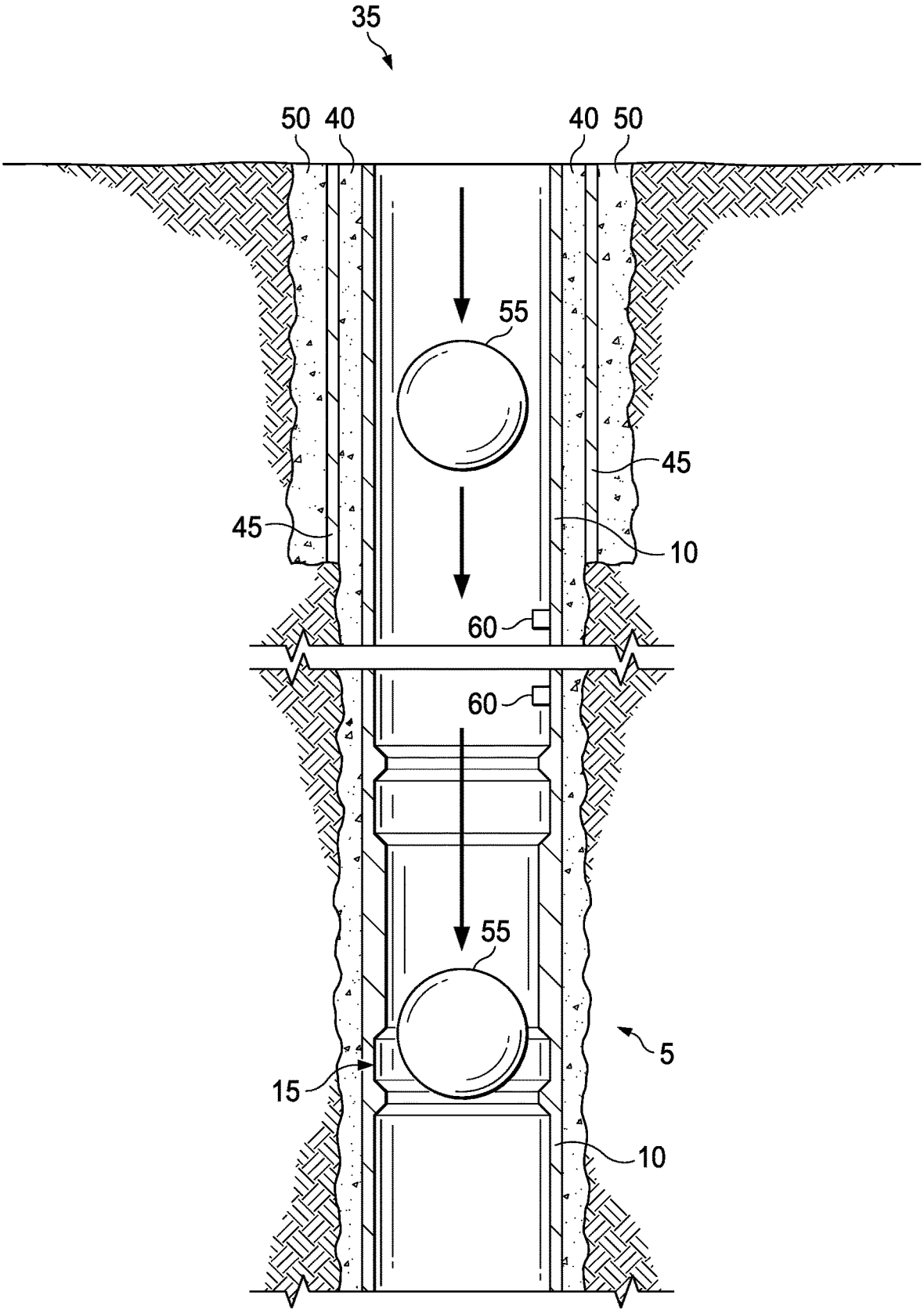
FIG. 3 illustrates a method of tracking a downhole device as it is displaced in a tubular.

FIG. 3 illustrates a method of tracking a downhole device as it is displaced in a tubular. FIG. 3 illustrates a restriction system 5 comprising a tubular 10. Tubular 10 is cemented into place in wellbore 35. Cement sheath 40 surrounds and positions tubular 10. Surface casing 45 and surface cement sheath 50 further surround tubular 10 and aid in securing tubular 10 within wellbore 35. Downhole device 55 may be introduced into wellbore 35 via tubular 10. Downhole device 55 may be any downhole device for use in a wellbore. For example, downhole device 55 may include, but is not limited to, plugs, darts, balls, and the like. As downhole device 55 is displaced in the wellbore, downhole device 55 traverses a first series of restrictions 15 disposed within tubular 10 at depth of 1,000 feet. Pressure sensor 60 senses the pattern of change in pressure within the tubular 10 as downhole device 55 traverses the first series of restrictions 15. Using a transducer, pressure sensor 60 generates a signal output of the pattern of pressure change. The pattern of pressure change is compared with the known pressure signature for the first series of restrictions 15. If the known pressure signature corresponds with the measured pattern of pressure change, the operator will know that the downhole device 55 has passed the first series of restrictions 15 and consequently has passed the depth of 1,000 feet.

Pressure sensor 60 may be any pressure sensor suitable for sensing the pressure within tubular 10. In some examples, pressure sensor 60 may also comprise a transducer sufficient to generate an output signal corresponding to the sensed pressure. Generally the pressure sensor may be any type of downhole gauge that is hermetically sealed and is sufficient for measuring the tubing pressure and changes within the tubing pressure.

Restriction systems are provided. An example restriction system comprises a tubular comprising at least one series of restrictions disposed on an interior surface of the interior of the tubular; a pressure sensor configured to measure the tubular pressure; and a downhole device capable of traversing the series of restrictions. The restriction system may further comprise a second series of restrictions on an interior surface of the interior of the tubular, wherein the second series of restrictions is disposed on an interior surface of the interior of the tubular at a different location from the first series of restrictions, wherein the second series of restrictions comprises a different pattern of restrictions from the first series of restrictions. The tubular may be a drill pipe, drill collar, pup joint, casing, production tubing, pipeline, or a combination thereof. The downhole device may be a plug, dart, or ball. The at least one series of restrictions may comprise a degradable plastic or metal. The at least one series of restrictions may comprise at least two metals capable of forming a galvanic couple. The at least one series of restrictions may be electrodeposited on the interior surface of the interior of the tubular.

Tubulars comprising series of restrictions are provided. An example tubular comprises at least one series of restrictions disposed on an interior surface of the interior of the tubular, and a pressure sensor disposed on an interior surface of the interior of the tubular. The tubular may further comprise a second series of restrictions on an interior surface of the interior of the tubular, wherein the second series of restrictions is disposed on an interior surface of the interior of the tubular at a different location from the first series of restrictions, wherein the second series of restrictions comprises a different pattern of restrictions from the first series of restrictions. The tubular may be a drill pipe, drill collar, pup joint, casing, production tubing, pipeline, or a combination thereof. A downhole device may be disposed within the interior of the tubular. The downhole device may be a plug, dart, or ball. The at least one series of restrictions may comprise a degradable plastic or metal. The at least one series of restrictions may comprise at least two metals capable of forming a galvanic couple. The at least one series of restrictions may be electrodeposited on the interior surface of the interior of the tubular.

Methods of tracking a downhole device as it is displaced in a tubular are provided. An example method comprises providing a tubular comprising at least one series of restrictions disposed on an interior surface of the interior of the tubular, and a pressure sensor disposed on an interior surface of the interior of the tubular. The example method further comprises introducing a downhole device into the tubular and measuring the pressure within the tubular as the downhole device traverses the at least one series of restrictions. The tubular may further comprise a second series of restrictions on an interior surface of the interior of the tubular, wherein the second series of restrictions is disposed on an interior surface of the interior of the tubular at a different location from the first series of restrictions, wherein the second series of restrictions comprises a different pattern of restrictions from the first series of restrictions. The tubular may be a drill pipe, drill collar, pup joint, casing, production tubing, pipeline, or a combination thereof. The downhole device may be a plug, dart, or ball. The at least one series of restrictions may comprise a degradable plastic or metal. The at least one series of restrictions may comprise at least two metals capable of forming a galvanic couple. The at least one series of restrictions may be electrodeposited on the interior surface of the interior of the tubular.

Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A restriction system comprising:

a tubular comprising at least one series of restrictions disposed on an interior surface of the interior of the tubular;

a pressure sensor disposed on an interior surface wall of the tubular and configured to measure the tubular pressure as a downhole device traverses the series of restrictions; wherein the measured tubular pressure is specific to the series of restrictions such that the measured tubular pressure signals that the downhole device has traversed the series of restrictions; and the downhole device capable of traversing the series of restrictions.

2. The restriction system of claim 1 further comprising a second series of restrictions on an interior surface of the interior of the tubular, wherein the second series of restrictions is disposed on an interior surface of the interior of the tubular at a different location from the first series of restrictions, wherein the second series of restrictions comprises a different pattern of restrictions from the first series of restrictions.

3. The restriction system of claim 1, wherein the tubular is a drill pipe, drill collar, pup joint, casing, production tubing, pipeline, or a combination thereof.

4. The restriction system of claim 1, wherein the downhole device is a plug, dart, or ball.

5. The restriction system of claim 1, wherein the at least one series of restrictions comprises a degradable plastic or metal.

6. The restriction system of claim 1, wherein the at least one series of restrictions comprises at least two metals capable of forming a galvanic couple.

7. The restriction system of claim 1, wherein the at least one series of restrictions was electrodeposited on the interior surface of the interior of the tubular.

8. A tubular comprising:

at least one series of restrictions disposed on an interior surface of the interior of the tubular, and a pressure sensor disposed on an interior surface wall of the interior of the tubular and configured to measure the tubular pressure as a downhole device traverses the series of restrictions; wherein the measured tubular pressure is specific to the series of restrictions such that the measured tubular pressure signals that the downhole device has traversed the series of restrictions.

9. The tubular of claim 8 further comprising a second series of restrictions on an interior surface of the interior of the tubular, wherein the second series of restrictions is disposed on an interior surface of the interior of the tubular at a different location from the first series of restrictions, wherein the second series of restrictions comprises a different pattern of restrictions from the first series of restrictions.

10. The tubular of claim 8, wherein the tubular is a drill pipe, drill collar, pup joint, casing, production tubing, pipeline, or a combination thereof.

11. The tubular of claim 8, wherein the at least one series of restrictions comprises a degradable plastic or metal.

12. The tubular of claim 8, wherein the at least one series of restrictions comprises at least two metals capable of forming a galvanic couple.

13. The tubular of claim 8, wherein the at least one series of restrictions was electrodeposited on the interior surface of the interior of the tubular.

14. A method of tracking a downhole device as it is displaced in a tubular, the method comprising:

providing a tubular comprising:

at least one series of restrictions disposed on an interior surface of the interior of the tubular, and a pressure sensor disposed on an interior surface wall of the interior of the tubular;

introducing a downhole device into the tubular; and measuring the pressure within the tubular as the downhole device traverses the at least one series of restrictions; wherein the measured tubular pressure is specific to the series of restrictions such that the measured tubular pressure signals that the downhole device has traversed the series of restrictions.

15. The method of claim 14 further comprising comparing a pattern of pressure change to a known pressure signature corresponding to the at least one series of restrictions.

16. The method of claim 14 further comprising a second series of restrictions on an interior surface of the interior of the tubular, wherein the second series of restrictions is disposed on an interior surface of the interior of the tubular at a different location from the first series of restrictions, wherein the second series of restrictions comprises a different pattern of restrictions from the first series of restrictions.

17. The method of claim 14, wherein the tubular is a drill pipe, drill collar, pup joint, casing, production tubing, pipeline, or a combination thereof.

18. The method of claim 14, wherein the downhole device is a plug, dart, or ball.

19. The method of claim 14, wherein the at least one series of restrictions comprises a degradable plastic or metal.

20. The method of claim 14, wherein the at least one series of restrictions comprises at least two metals capable of forming a galvanic couple.

* * * * *